US009465341B2

(12) United States Patent
Hagiwara

(10) Patent No.: US 9,465,341 B2
(45) Date of Patent: Oct. 11, 2016

(54) IMAGE FORMING APPARATUS THAT DETECTS VARIATION IN ROTATION PERIOD OF ROTATING MEMBER AND PERFORMS MISREGISTRATION CORRECTION

(71) Applicant: CANON KABUSHIKI KAISHA, Tokyo (JP)

(72) Inventor: Hiroshi Hagiwara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/252,927

(22) Filed: Apr. 15, 2014

(65) Prior Publication Data

US 2014/0321890 A1 Oct. 30, 2014

(30) Foreign Application Priority Data

Apr. 24, 2013 (JP) ..... 2013-091788

(51) Int. Cl.
*G03G 15/01* (2006.01)
*G03G 15/00* (2006.01)

(52) U.S. Cl.
CPC ..... *G03G 15/5058* (2013.01); *G03G 15/0189* (2013.01); *G03G 2215/0161* (2013.01)

(58) Field of Classification Search
USPC ..... 399/301, 395, 396
See application file for complete search history.

(56) References Cited

U.S. PATENT DOCUMENTS 7,773,925 B2 * 8/2010 Ikeda ..... 399/301
7,848,689 B2 * 12/2010 Matsuda et al. ..... 399/301
7,885,587 B2 * 2/2011 Matsuda ..... G03G 15/5008 399/301
8,346,111 B2 * 1/2013 Maehata et al. ..... 399/66
8,600,274 B2 12/2013 Uchiyama et al.
2009/0003854 A1 * 1/2009 Naoi et al. ..... 399/38
2009/0245820 A1 * 10/2009 Shiobara ..... G03G 15/751 399/27
2011/0274461 A1 * 11/2011 Imai ..... 399/110

(Continued)

FOREIGN PATENT DOCUMENTS

JP 01-040956 A 2/1989
JP 07-295323 A 11/1995

(Continued)

OTHER PUBLICATIONS

Kentaro Yamashita, Yasu Yoda, Akinobu Hirayama, Takateru Ohkubo, Kenji Watanabe, Hiromitsu Kumada, Yoshiko Kubo, Hiroshi Hagiwara, Shuhei Watanabe, U.S. Appl. No. 14/366,375, filed Jun. 18, 2014.

*Primary Examiner* — David Gray
*Assistant Examiner* — Warren K Fenwick
(74) *Attorney, Agent, or Firm* — Fitzpatrick, Cella, Harper & Scinto

(57) ABSTRACT

An image forming apparatus includes a rotating member; a forming unit for each of a plurality of colors used in image formation, configured to form a developer image of the corresponding color on the rotating member or on a recording medium on the rotating member; a driving unit configured to rotate the rotating member; a period detection unit configured to detect a rotation period of the rotating member; and a control unit configured to, according to a detection result detected by the period detection unit, obtain a variation in the rotation period of the rotating member due to a change in the driving unit, and perform correction control for misregistration in the developer image formed on the rotating member or on the recording medium on the rotating member by the forming unit.

12 Claims, 10 Drawing Sheets

(56) References Cited

U.S. PATENT DOCUMENTS

2011/0280642 A1* 11/2011 Ikeda et al. ..... 400/582
2014/0016955 A1 1/2014 Uchiyama et al.

FOREIGN PATENT DOCUMENTS

JP 2003-233234 A 8/2003
JP 2006-085055 A 3/2006

* cited by examiner

IMAGE FORMING APPARATUS THAT DETECTS VARIATION IN ROTATION PERIOD OF ROTATING MEMBER AND PERFORMS MISREGISTRATION CORRECTION

BACKGROUND OF THE INVENTION

1. Field of the Invention

The present invention relates to an image forming apparatus that uses an electrophotographic method, and in particular relates to an image forming apparatus that includes an intermediate transfer belt or an electrostatic conveyance belt.

2. Description of the Related Art

With an electrophotographic image forming apparatus, a so-called tandem type is known where an image forming unit is provided individually for each color in order to print at a high speed. A tandem image forming apparatus having an intermediate transfer belt successively transfers images from the image forming units for the respective colors onto the intermediate transfer belt and furthermore transfers the images all at once from the intermediate transfer belt onto a recording medium. Also, with a tandem image forming apparatus having an electrostatic conveyance belt, images are transferred from the image forming units for the respective colors onto a recording medium on an electrostatic conveyance belt. Note that in the description below, "belt" is used to refer to the intermediate transfer belt and the electrostatic conveyance belt collectively.

With this type of image forming apparatus, color misregistration (misregistration) can occur when the images are overlaid on each other due to mechanical factors in the image forming units for the respective colors. For example, the belt or a roller driving the belt expands/contracts due to temperature change inside of the image forming apparatus, and the movement speed of the belt surface (hereinafter referred to as the belt speed) changes. Due to the change in belt speed, a shift occurs in the position at which the images are overlaid, which causes color misregistration.

Because of this, Japanese Patent Laid-Open No. 2003-233234 discloses a configuration where misregistration is controlled by installing a sensor for detecting the rotation speed of a driven roller that is driven by the rotation of the belt and performing rotation speed control for the driving motor of the belt such that the rotation speed of the driven roller is a constant speed.

However, as described above, in order to provide a sensor for detecting the rotation speed of the driven roller of the belt, it is necessary to secure an installment position for the sensor, which will cause the size of the image forming apparatus to increase, and the cost will furthermore increase.

SUMMARY OF THE INVENTION

According to an aspect of the present invention, an image forming apparatus includes a rotating member; a forming unit for each of a plurality of colors used in image formation, configured to form a developer image of the corresponding color on the rotating member or on a recording medium on the rotating member; a driving unit configured to rotate the rotating member; a period detection unit configured to detect a rotation period of the rotating member; and a control unit configured to, according to a detection result detected by the period detection unit, obtain a variation in the rotation period of the rotating member due to a change in the driving unit, and perform correction control for misregistration in the developer image formed on the rotating member or on the recording medium on the rotating member by the forming unit.

Further features of the present invention will become apparent from the following description of exemplary embodiments with reference to the attached drawings.

DESCRIPTION OF THE EMBODIMENTS

Figure 1:
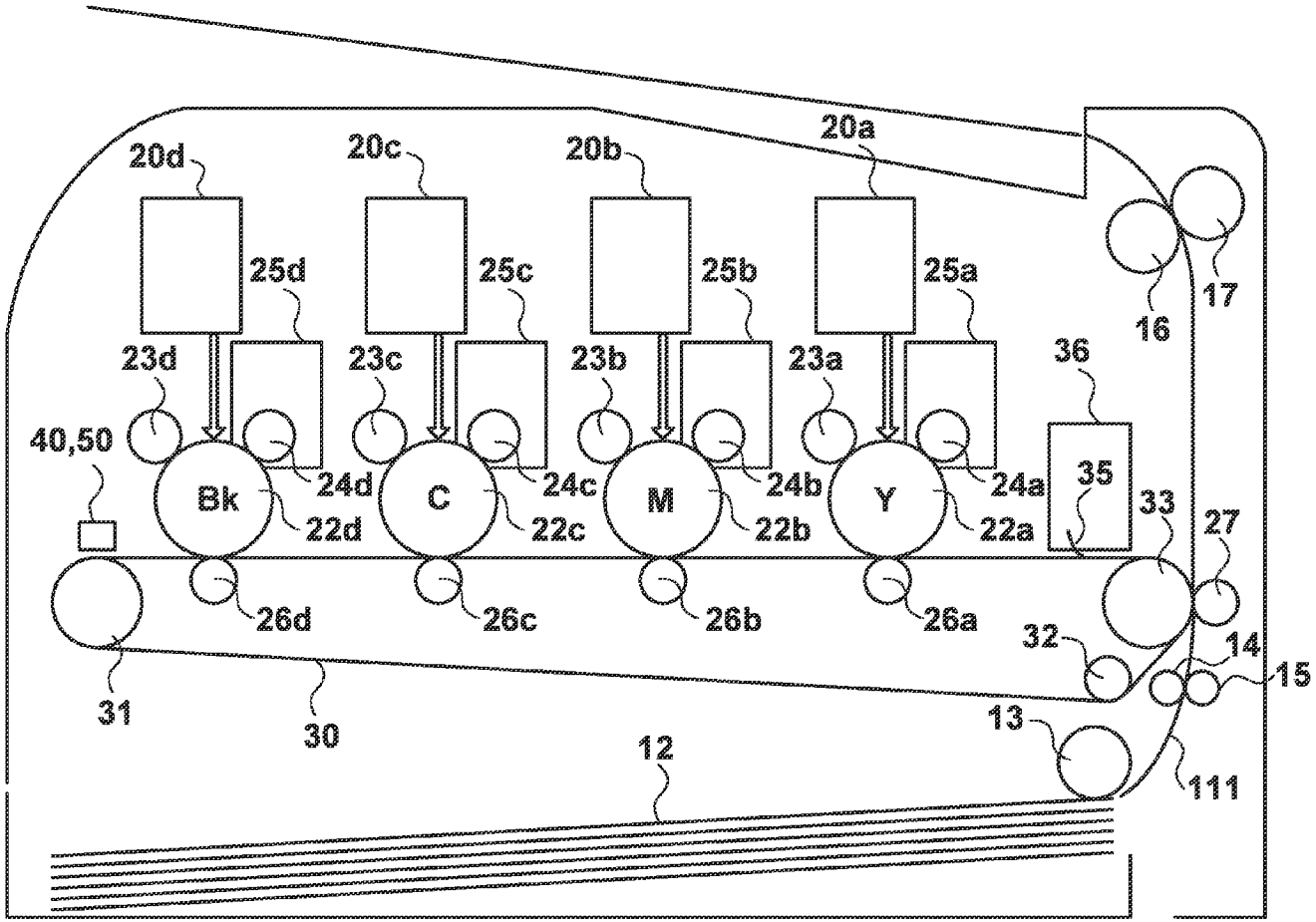
FIG. 1 is a diagram of a schematic configuration of an image forming apparatus according to an embodiment.

Embodiments of the present invention will be described below with reference to the drawings. Note that the embodiment below is an example and the present invention is not limited thereto. Also, constituent elements that are not needed in the description of the embodiments are not included in the drawings below.

First Embodiment

FIG. 1 is a diagram of a schematic configuration of the image forming apparatus according to the present embodiment. In FIG. 1, members having the letters a, b, c, and d attached to the ends of their reference numbers are for forming yellow, magenta, cyan, and black developer images respectively on the intermediate transfer belt 30. Note that if it is not necessary to distinguish between colors in the description below, reference numbers that do not include letters on the end will be used. A charge roller 23 charges the surface of a photosensitive member 22 that is driven so as to rotate. For example, the charge roller 23 outputs a charge bias of −1200 V, which charges the surface of the photosensitive member 22 to −700 V. A scanner unit 20 emits a laser light to the charged photosensitive member 22 according to the image that is to be formed, and forms an electrostatic latent image on the photosensitive member 22. For example, the electric potential at locations on the photosensitive member 22 where the laser light was emitted is −100 V. The developing device 25 has developer of the corresponding color, supplies the developer to the electrostatic latent image on the photosensitive member 22 using a developing bias output by a developing sleeve 24, and makes the electrostatic latent image visible as a developer image. The developing bias output by the developing sleeve 24 is −350 V, for example. A primary transfer roller 26 outputs a primary transfer bias of +1000 V for example and transfers the developer image formed on the photosensitive member 22 onto the intermediate transfer belt 30 (endless belt). Note that at this time, the developer images on the photosensitive member 22 are transferred onto the intermediate transfer belt 30 such that they are overlaid, and thereby a color image can be formed.

The intermediate transfer belt 30 is a rotating member that is driven in a loop by rollers 31, 32, and 33 and conveys the developer images to the position of a secondary transfer roller 27. On the other hand, when the leading edge of a recording medium 12 that has been sent by a pick-up roller 13 to the conveyance path 111 has gone slightly past the position of a pair of conveyance rollers 14 and 15, its conveyance is temporarily stopped. Then, the conveyance of the recording medium 12 is resumed so as to match the timing when the developer images arrive at the position of the secondary transfer roller 27, and the developer images on the intermediate transfer belt 30 are transferred onto the recording medium 12 by the secondary transfer roller 27. Note that as will be described later, multiple marks are formed on the intermediate transfer belt 30, and by detecting the marks using a period detection sensor 40, the time when the developer images reach the position of the secondary transfer roller 27 can be obtained. Developer that has not been transferred to the recording medium 12 and remains on the intermediate transfer belt 30 is recovered in a container 36 by a cleaning blade 35. The recording medium 12 onto which the developer image has been formed is conveyed by a pair of fixing rollers 16 and 17, and after the developer images have been fixed thereto, the recording medium 12 is ejected from the image forming apparatus. Note that a pattern detection sensor 50 is provided in order to detect a detection pattern, which is formed on the intermediate transfer belt 30 with developer for misregistration correction at the time of misregistration correction control.

Note that the group of members that are directly involved in forming the developer images, which includes the scanner unit 20, the photosensitive member 22, the electrostatic roller 23, the developing device 25, and the primary transfer roller 26 are referred to as an image forming unit. Depending on the case, the image forming unit need not include the scanner unit 20.

Figure 2:
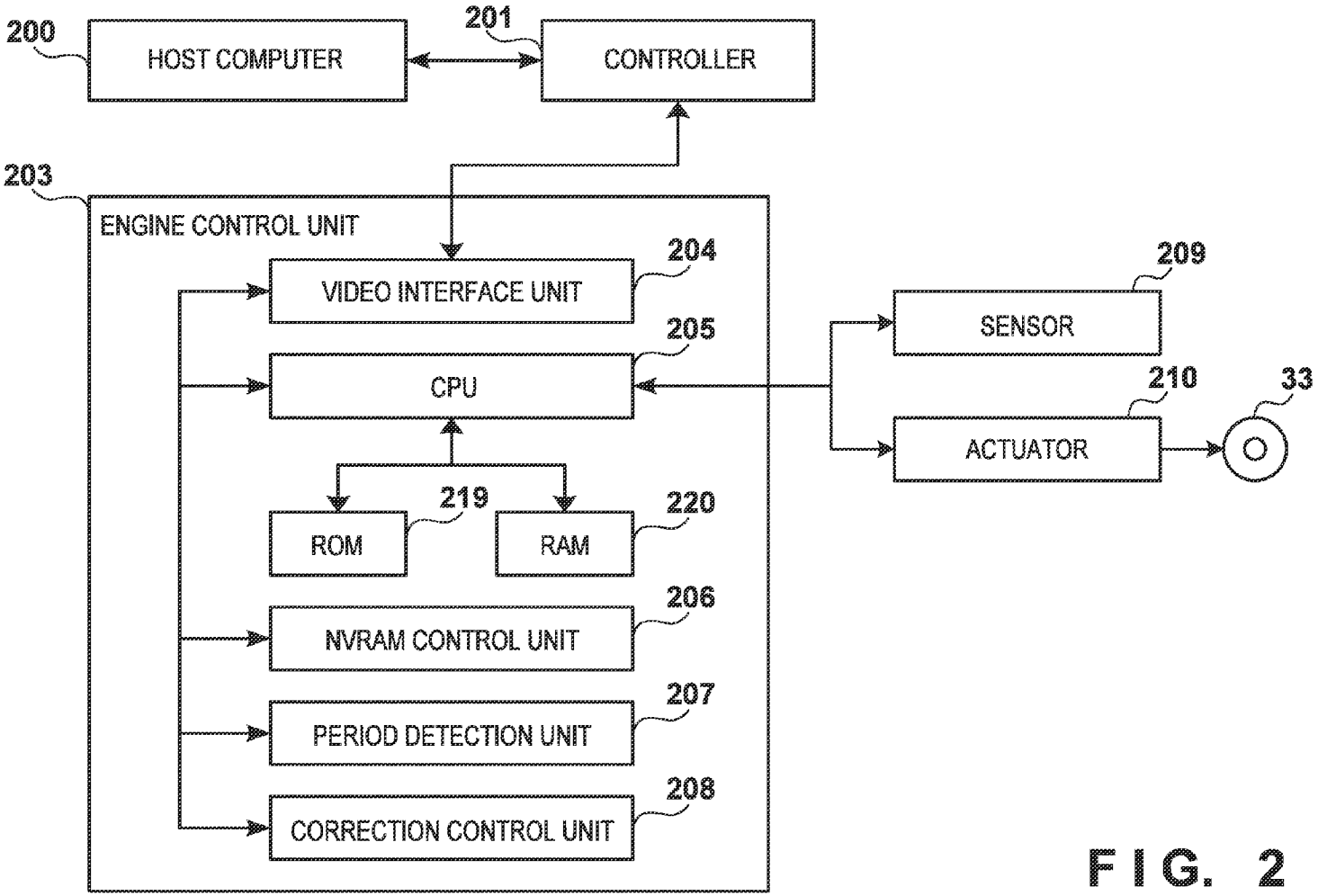
FIG. 2 is a block diagram showing a system configuration of the image forming apparatus according to an embodiment.

FIG. 2 is a block diagram showing a control configuration of the image forming apparatus. A controller 201 receives image information and a print instruction from a host computer 200, analyzes the received image information, and converts it into bit data. Then, the controller 201 sends a video signal including a print reservation command, a print start command, and the bit data for each recording medium 12 to an engine control unit 203 via a video interface unit 204. A CPU 205 in the engine control unit 203 performs image formation by controlling actuators 210 based on information received from various sensors 209 in the image forming apparatus. Note that a ROM 219 stores program codes executed by the CPU 205 and data used by the CPU 205, and a RAM 220 is used by the CPU 205 for temporarily storing data. Each actuator 210 includes a driving motor for the roller 33, and the intermediate transfer belt 30 is rotated by the driving motor rotating the roller 33. Also, the sensors 209 include the period detection sensor 40 and the pattern detection sensor 50. An NVRAM control unit 206 controls an NVRAM, which is a non-volatile memory, a period detection unit 207 detects a later-described rotation period of the intermediate transfer belt 30, and a correction control unit 208 performs misregistration correction control, which will be described later.

Figure 3A:
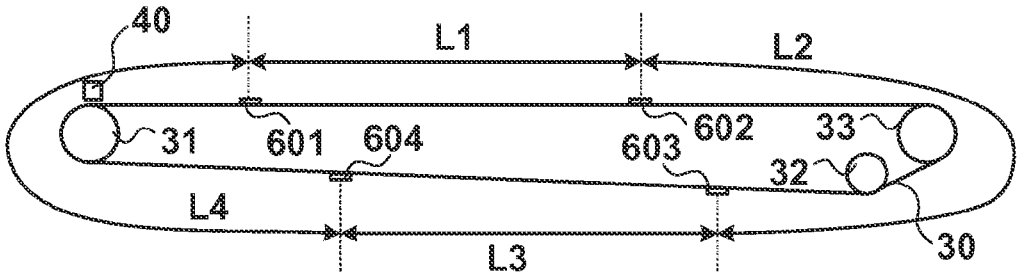
FIGS. 3A and 3B are diagrams showing marks on the intermediate transfer belt according to an embodiment.
Figure 3B:
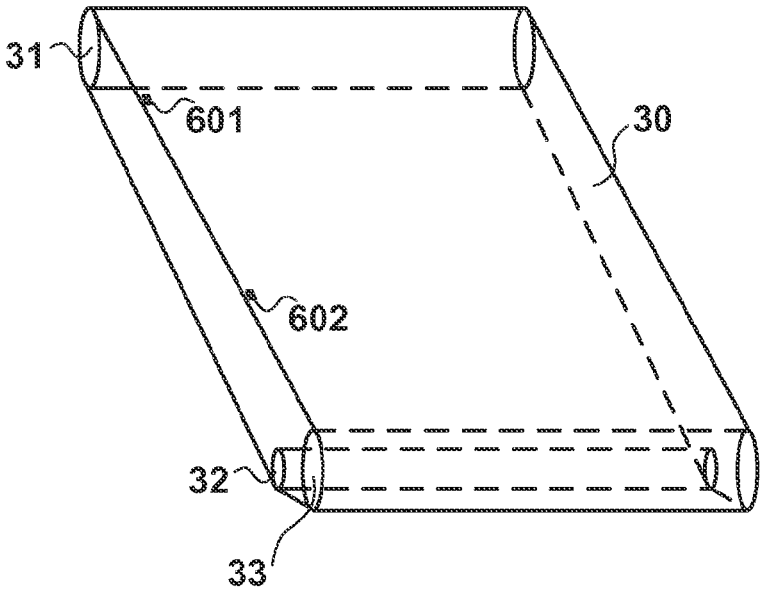

FIGS. 3A and 3B show the arrangement of marks for detecting a rotation period of the intermediate transfer belt 30, FIG. 3A being a cross-sectional view, and FIG. 3B being a perspective view. Marks 601, 602, 603, and 604 are provided on the edge portion in the main scanning direction on the surface of the intermediate transfer belt 30 and are detected by the period detection sensor 40. Here, the distance between the mark 601 and the mark 602 is L1, the distance between the mark 602 and the mark 603 is L2, the distance between the mark 603 and the mark 604 is L3, and the distance between the mark 604 and the mark 601 is L4. Note that the distances are the distances between the centers of the corresponding marks. In the present embodiment, the distances L1 to L4 between adjacent marks are set as follows.

$$L1<L2<L3<L4$$

Rotation period detection processing using the marks 601 to 604 above for the intermediate transfer belt 30 will be described next with reference to FIG. 4. Note that in the measurement of the rotation period of the intermediate transfer belt 30, the intermediate transfer belt 30 is rotated in advance. The period detection unit 207 starts mark detection by initializing a detection counter to 0 in step S10 and starting the period detection sensor 40 in step S11. When the period detection sensor 40 detects a mark in step S12, the period detection unit 207 increments the detection counter by 1 in step S13. Subsequently, in step S14, the period detection unit 207 determines whether or not the detection counter is 1, and if it is 1, a timer is started in step S15 and the procedure moves to step S16. Note that if the detection counter is not 1 in step S14, the processing moves directly to step S16. The period detection unit 207 determines in step S16 whether or not the detection counter is less than 5, and if it is less than 5, the processing is repeated from step S12. On the other hand, if the detection counter is not less than 5 in step S16, the period detection unit 207 stops the timer in step S17 and calculates the rotation period of the intermediate transfer belt 30 in step S18. In the processing shown in FIG. 4, a timer measures the amount of time from when a mark is first detected until when four marks are furthermore detected. Since there are four marks provided on the intermediate transfer belt 30 in the present embodiment, the measured amount of time is a rotation period T in which the intermediate transfer belt 30 performs one rotation. Note that four marks have been formed in the processing shown in FIG. 4, but the number of marks that are formed can be a value other than four. Also, the relationship for the distances between the marks is not limited to the above-described relationship.

The rotation period T, the circumferential length L, and the belt speed V of the intermediate transfer belt 30 have a relationship such that $T \times V = L$. Here, the belt speed V of the intermediate transfer belt 30 means the movement speed of the surface of the intermediate transfer belt 30 in the case where, when the diameter of the roller 33 that drives the intermediate transfer belt 30 is a nominal roller diameter R, the roller 33 is driven at an angular speed ω. However, the diameter of the roller 33 undergoes thermal expansion due to environmental temperature change and deviates from the nominal roller diameter R. Accordingly, even if the roller 33 is rotated at the angular speed ω, the belt speed of the intermediate transfer belt 30 will rotate at an actual belt speed V' that differs from the ideal belt speed V.

Figure 5:
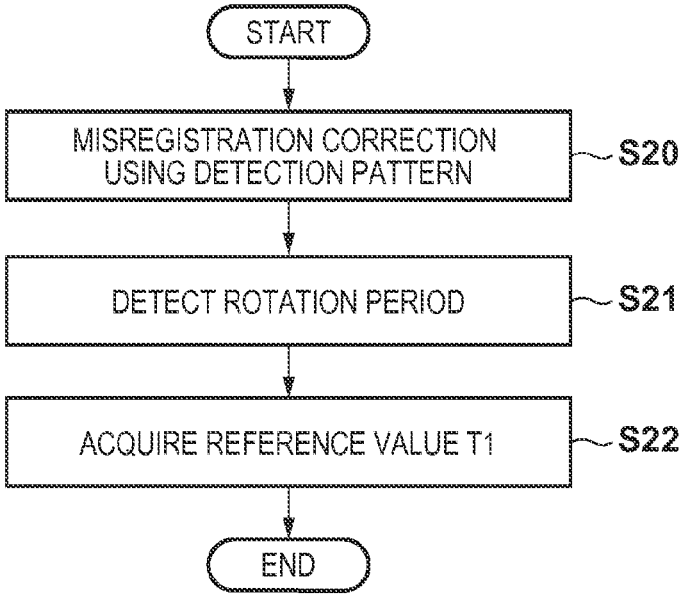
FIG. 5 is a flowchart for reference value acquisition processing according to an embodiment.
Figure 6:
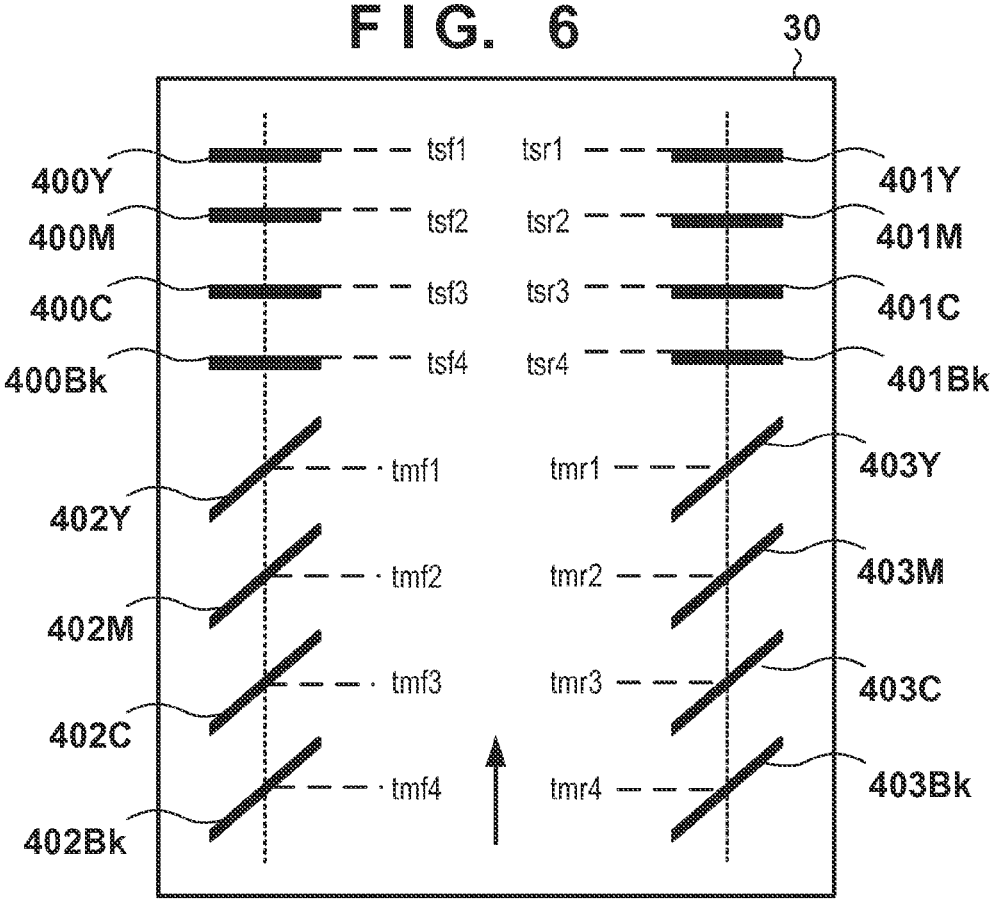
FIG. 6 is a diagram showing a detection pattern according to an embodiment.

Misregistration correction control using the rotation period will be described next. In the present embodiment, reference values are acquired first in order to correct misregistration caused by variation in the rotation period of the intermediate transfer belt 30. Reference value acquisition processing will be described below with reference to FIG. 5. In step S20, the correction control unit 208 forms the detection patterns with the developer images for misregistration detection on the intermediate transfer belt 30 and performs misregistration correction. FIG. 6 shows the detection patterns.

In FIG. 6, marks 400 and 401 are patterns for detecting the misregistration amount in the conveyance direction (sub-scanning direction) of the recording medium 12. Also, marks 402 and 403 are patterns for detecting the misregistration amount in the main scanning direction that is orthogonal to the conveyance direction of the recording medium 12. Note that the arrow in FIG. 6 indicates the movement direction of the intermediate transfer belt 30 and corresponds to the sub-scanning direction. In the example in FIG. 6, the marks 402 and 403 are inclined 45 degrees relative to the main scanning direction. Note that the letters Y, M, C, and Bk on the ends of the reference numerals of the marks 400 to 403 indicate that the corresponding marks are formed with yellow, magenta, cyan, and black developer respectively. Also, tsf 1 to 4, tmf 1 to 4, tsr 1 to 4, and tmr 1 to 4 of the marks indicate the detection timing of the corresponding marks detected by the pattern detection sensor 50. Note that a widely-known technique can be used for mark detection performed by the pattern detection sensor 50, such as performing detection using light that is reflected when emitted to the marks.

The position correction of magenta using yellow as a reference color will be described below as a representative example. However, the other position corrections of cyan and black are similar to the description below. The belt speed of the intermediate transfer belt 30 is indicated by V, and the theoretical distances between the yellow marks 400 and 401 and the magenta marks 400 and 401 are indicated by dsM. In this case, the magenta sub-scanning direction misregistration amount δesM is expressed as follows:

$$\delta esM = V \times \{(tsf2 - tsf1) + (tsr2 - tsr1)\}/2 - dsM$$

Also, for the main scanning direction, for example, the left-side magenta misregistration amount δemfM is expressed as follows:

$$\delta emfM = V \times (tmf2 - tsf2) - V \times (tmf1 - tsf1)$$

The right-side magenta misregistration amount δemrM is expressed similarly. Note that the signs of δemfM and δemrM indicate the direction of shifting in the main scanning direction. The engine control unit 203 corrects the write start position for magenta based on δemfM, and corrects the width in the main scanning direction, or in other words, the main scanning scale factor based on δemrM−δemfM. Note that if there is an error in the main scanning scale factor, the write start position is calculated based not only on δemfM, but also on the amount of change in the image frequency (image clock) that changes accompanying the correction of the main scanning scale factor. The engine control unit 203 changes the timing at which the scanner unit 20*b* emits the laser light for example, so as to perform correction by the calculated misregistration amount. For example, if the position has shifted by four lines in the sub-scanning direction, the engine control unit 203 changes the emission timing of the laser light for forming the magenta electrostatic latent image by four lines. In this way, the processing in step S20 enables the subsequent reference value acquisition processing to be performed in a state where the misregistration amount has been reduced.

Figure 4:
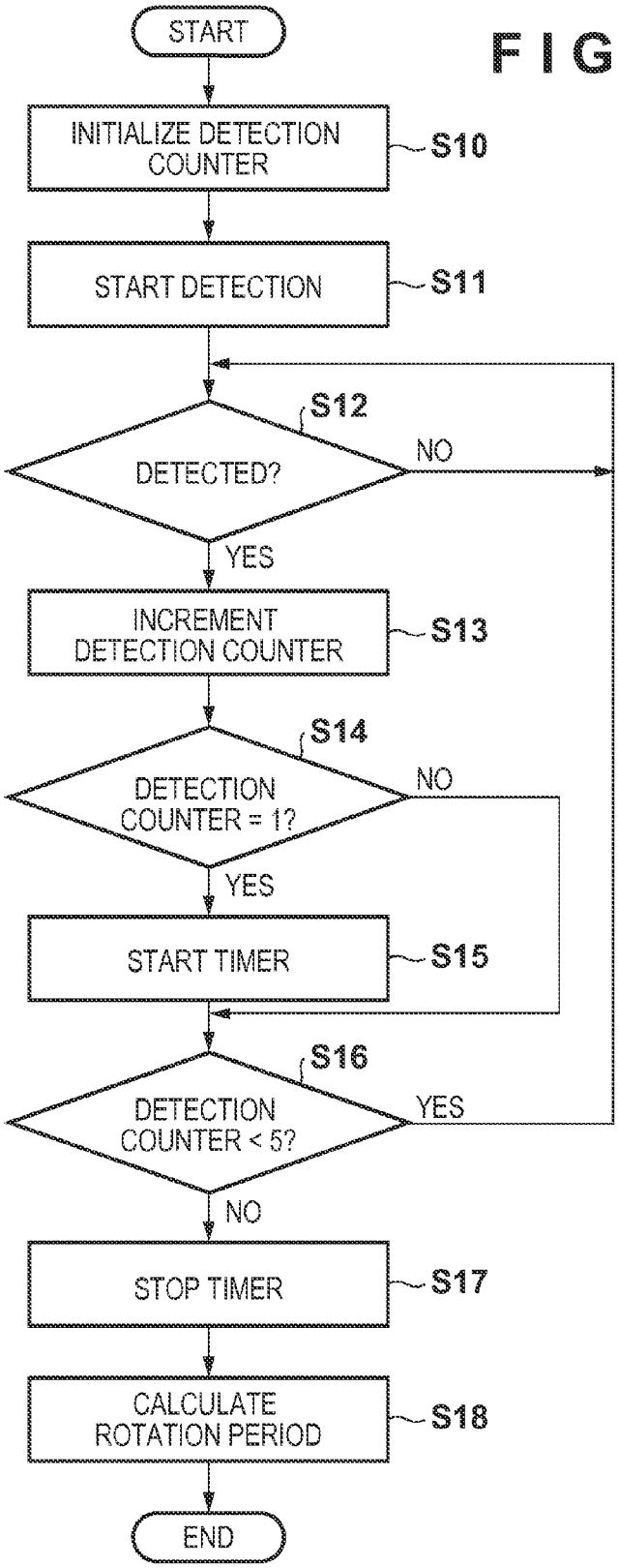
FIG. 4 is a flowchart for rotation period detection processing according to an embodiment.

Returning to FIG. 5, in step S21, the correction control unit 208 causes the period detection unit 207 to perform the processing shown in FIG. 4 and stores the acquired rotation period T1 as the reference value T1 in the RAM 220, or causes the NVRAM control unit 206 to store it in the non-volatile memory. The reference value T1 is thereafter the target value when performing position adjustment according to the rotation period. Note that in the processing in FIG. 5, the processing of step S20 and the processing of step S21 can be performed simultaneously, or in other words, in parallel.

After the acquisition of the reference value, the internal temperature of the apparatus changes due to successive printing or the like and the diameter of the roller 33 undergoes thermal expansion, whereby the belt speed of the intermediate transfer belt 30 changes, which causes variation in the amount of time for the intermediate transfer belt 30 to move between transfer positions on the primary transfer rollers 26, and therefore misregistration occurs. Thus, if the internal temperature of the apparatus changes, or if a predetermined number of pages have been printed, misregistration correction control, which will be described below with reference to FIG. 7, is performed in the present embodiment.

Figure 7:
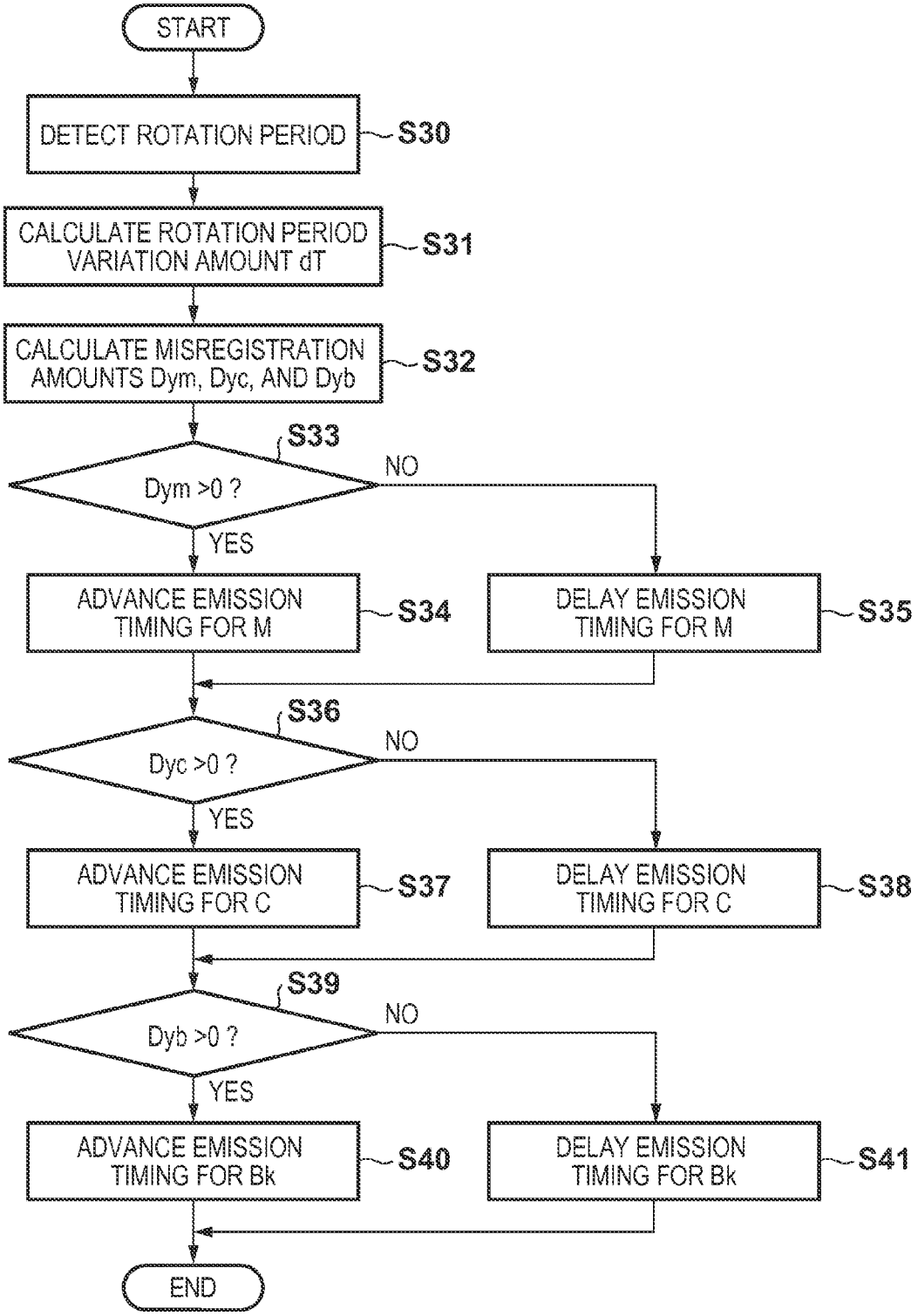
FIG. 7 is a flowchart for misregistration correction control according to an embodiment.

First, in step S30 in FIG. 7, the correction control unit 208 causes the period detection unit 207 to perform the processing shown in FIG. 4 and acquires a rotation period T2, and in step S31, the correction control unit 208 calculates a rotation period variation amount dT.

$$dT = T2 - T1$$

Thereafter, in step S32, the correction control unit 208 uses the equations below to obtain misregistration amounts Dym, Dyc, and Dyb for magenta, cyan, and black respectively, with respect to yellow, which is the reference color in the present embodiment.

$$Dym = dT \times V \times Lym/L$$

$$Dyc = dT \times V \times Lyc/L$$

$$Dyb = dT \times V \times Lyb/L$$

Here, Lym, Lyc, and Lyb are the respective distances between the transfer position for the primary transfer roller 26*a* corresponding to yellow, and the transfer positions for the primary transfer rollers 26*b*, 26*c*, and 26*d* corresponding to magenta, cyan, and black. Nominal values or values measured at the time of factory assembly are stored in the non-volatile memory as the distances Lym, Lyc, and Lyb. Note that as described above, the circumferential length L is the nominal value of the intermediate transfer belt 30, and V is a theoretical belt speed obtained based on the nominal value of the diameter and rotation speed of the roller 33 that drives the intermediate transfer belt 30. Note that the circumferential length L may be set to be approximately L=T1×V based on the reference value T1 and the theoretical belt speed V for example. As described above, the amount of misregistration that occurs due to a change in the belt speed of the intermediate transfer belt 30 can be calculated based on the rotation period variation amount dT and the theoretical or ideal belt speed V.

The correction control unit 208 determines in step S33 whether or not Dym is greater than 0. If Dym is greater than 0, in step S34, the correction control unit 208 advances the emission timing of the laser light in the scanner unit 20*b* that corresponds to magenta in accordance with the misregistration amount. On the other hand, if Dym is less than 0, in step S35, the correction control unit 208 delays the emission timing of the laser light in the scanner unit 20*b* that corresponds to magenta in accordance with the shift amount. Note that it is evident that if Dym is 0, there is no misregistration in magenta with respect to yellow, and the emission timing of the scanner unit 20*b* does not need to be changed. Similarly, the correction control unit 208 adjusts the emission timing of the laser light in the scanner unit 20*c* that corresponds to cyan in steps S36 to S38 and adjusts the emission timing of the laser light in the scanner unit 20*d* that corresponds to black in steps S39 to S41. By controlling the forming position of the electrostatic latent image on the photosensitive member 22 according to the above description, the misregistration amount can be returned to the state at the time of measuring the reference value T1.

According to the present embodiment, misregistration caused by variation in the belt speed of the intermediate transfer belt 30 can be corrected without providing a sensor for detecting the rotation speed of a roller of the intermediate transfer belt 30.

Note that in the present embodiment, misregistration is corrected by changing the emission timing of the scanner unit 20, but the present invention is not limited to adjusting the emission timing. For example, it is possible to correct misregistration by adjusting mechanical position using a reflection mirror included in the scanner unit 20. Note that the rotation period detection performed by the period detection unit 207 can be performed in parallel with a printing operation. In other words, misregistration correction may be performed in parallel with a printing operation.

Second Embodiment

Figure 8:
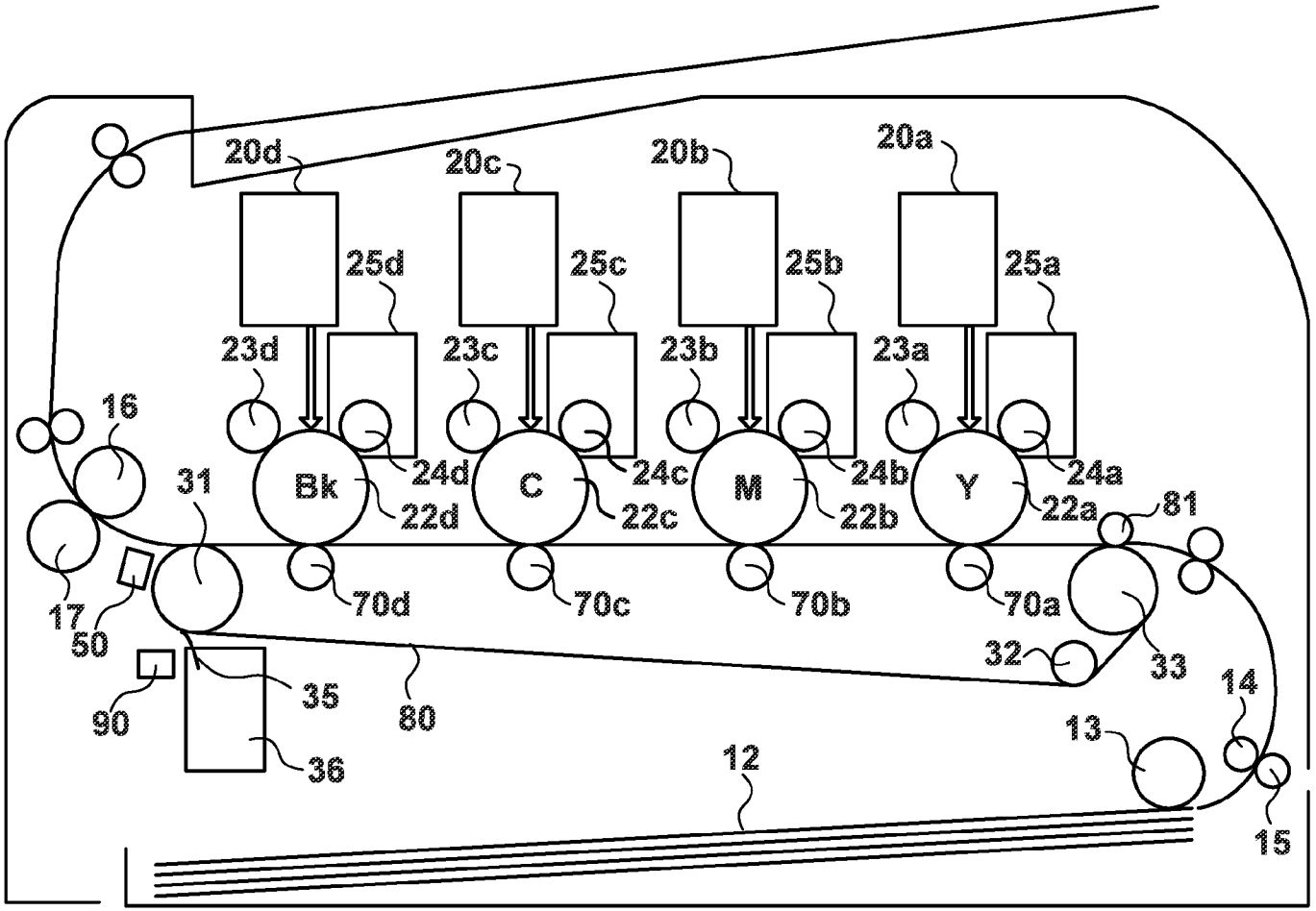
FIG. 8 is a diagram of a schematic configuration of the image forming apparatus according to an embodiment.

Next, a second embodiment will be described with a focus on differences from the first embodiment. In contrast to the first embodiment, the image forming apparatus includes an electrostatic conveyance belt 80, which is a rotating member, in place of the intermediate transfer belt 30 in the present embodiment. FIG. 8 is a diagram of a schematic configuration of the image forming apparatus according to the present embodiment. A contact roller 81 holds the recording medium 12 between itself and the electrostatic conveyance belt 80 and brings the recording medium 12 into close contact with the electrostatic conveyance belt 80. Transfer rollers 70 transfer the electrostatic latent images formed on the photosensitive members 22 onto the recording medium 12 on the electrostatic conveyance belt, or in other words, the rotating member. A temperature sensor 90 provided in the vicinity of the cleaning blade 35 measures the internal temperature of the image forming apparatus. Other constituent elements of the image forming apparatus in FIG. 8 are similar to those in the first embodiment and are denoted by the same reference numbers, and the description thereof will not be repeated. In the present embodiment, the rotation period of the electrostatic conveyance belt 80 is detected by the pattern detection sensor 50 to perform misregistration correction.

Figure 9A:
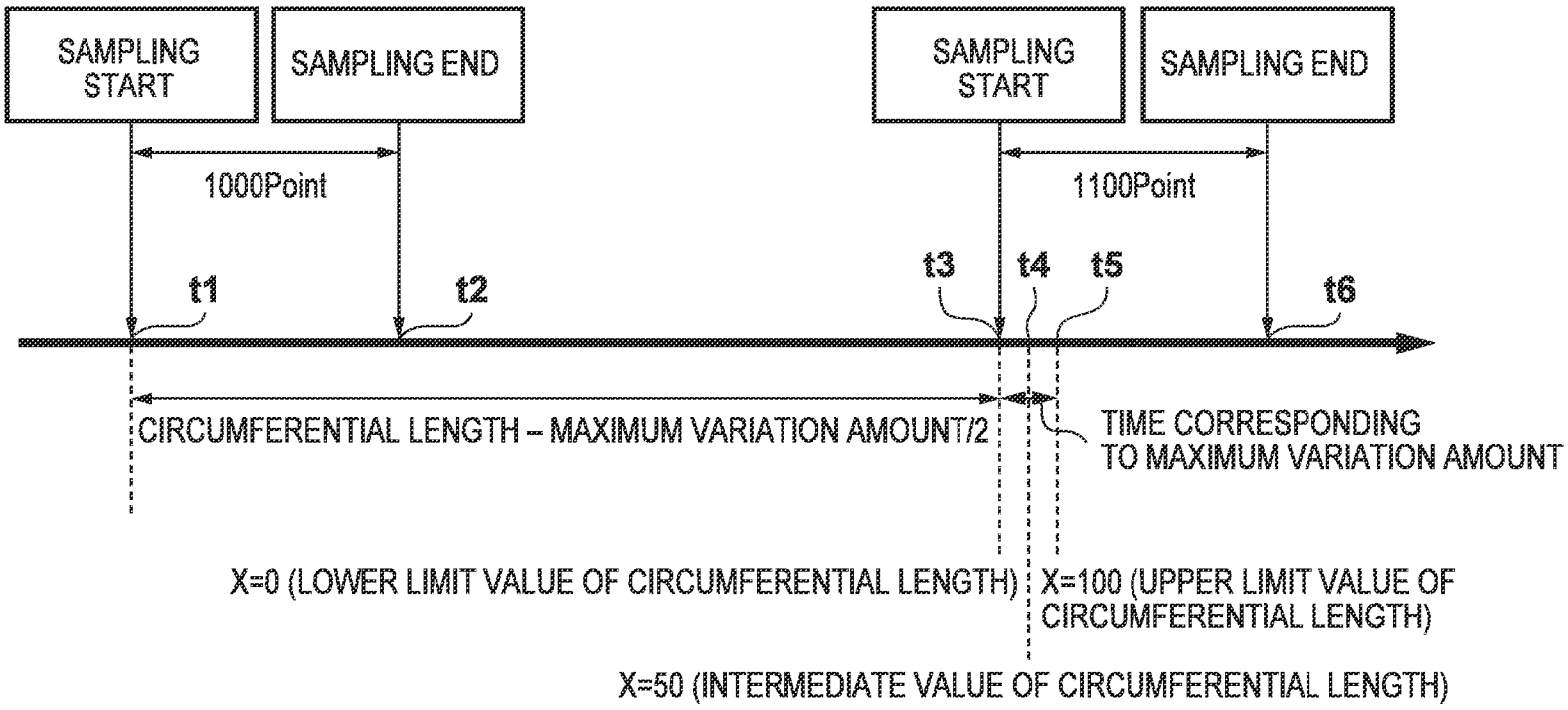
FIGS. 9A and 9B are diagrams for describing the rotation period detection principle according to an embodiment.
Figure 9B:
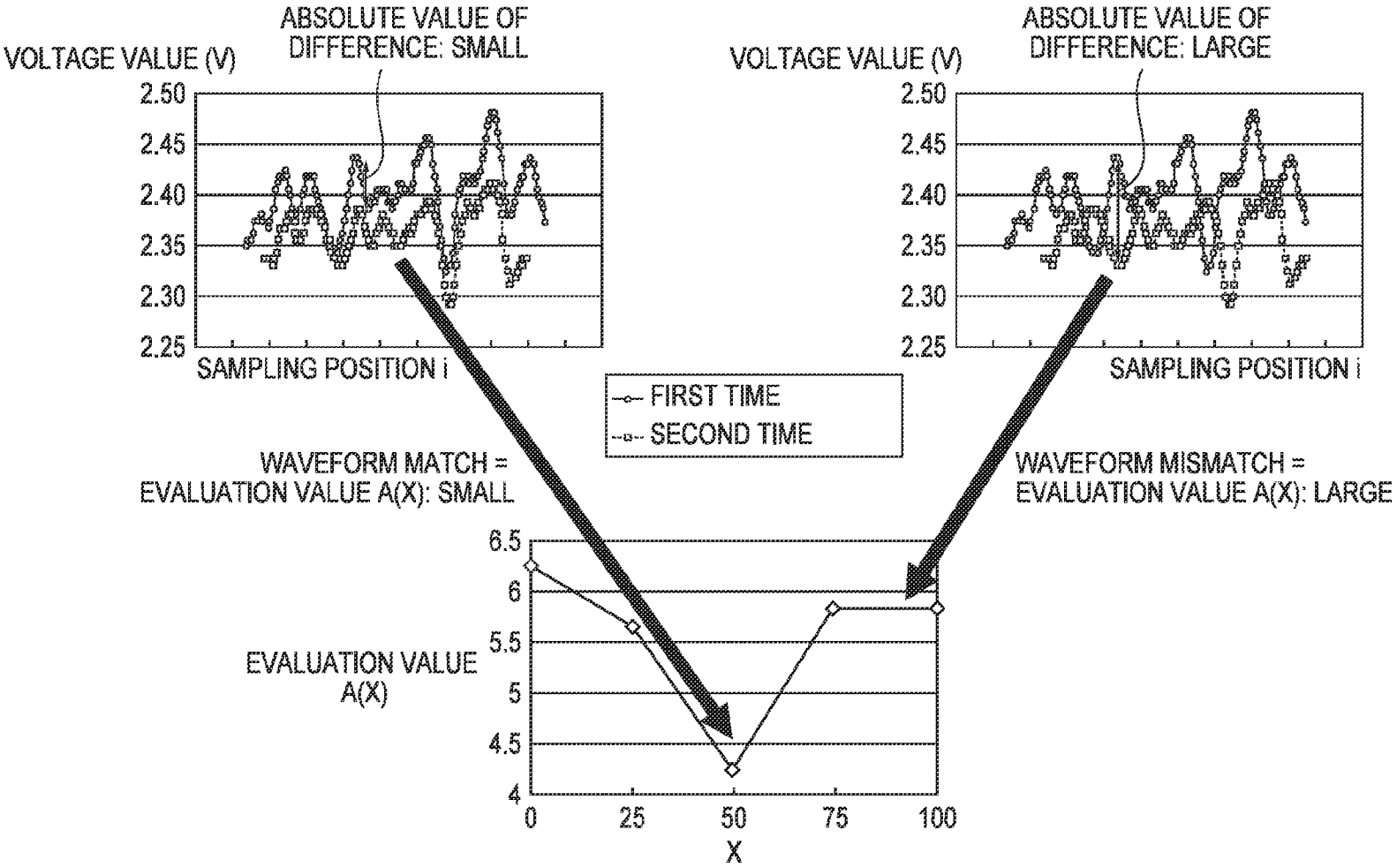

Rotation period detection according to the present embodiment will be described below with reference to FIGS. 9A and 9B. Note that the specific numeric values used in the description below are examples. The period detection unit 207 causes the electrostatic conveyance belt 80 to rotate at a fixed speed and causes the pattern detection sensor 50 to emit light toward the electrostatic conveyance belt 80. Then, as shown in FIG. 9A, the period detection unit 207 acquires a reflected light amount Q1(i) (i=1 to N) received by the pattern detection sensor 50 from the surface of the electrostatic conveyance belt 80 as first waveform data in a predetermined sampling interval S from time t1 to time t2. Specifically, in the example in FIG. 9A, N=1000. Next, the period detection unit 207 acquires a reflected light amount Q2(i) (i=1 to N+X) from the surface of the electrostatic conveyance belt 80 as second waveform data in a sampling interval S, starting from the position near the surface of the electrostatic conveyance belt 80 where the first sampling was started. In the example in FIG. 9A, the second sampling is performed from time t3 to time t6, and X=100. Note that, with respect to a maximum variation amount My for the circumferential length of the electrostatic conveyance belt 80, the distance between the start position for the first sampling and the start position for the second sampling is (L−Mv/2). Note that L is the nominal value for the circumferential length of the electrostatic conveyance belt 80. In this way, the second waveform data (second sampling) is acquired such that at least a portion of the first data (first sampling) is included therein. Note that here, as an example, a description has been given for the case where sampling is performed more times for the second waveform data than for the first waveform data. However, the present invention is not limited to this, and the number of times sampling is performed for the second waveform data may be equal to, or less than that for the first waveform data, as long as the second waveform data is acquired such that at least a portion of the first waveform data is included therein.

Here, the second sampling is performed more times than the first sampling is performed since consideration is given to variation in the circumferential length of the electrostatic conveyance belt 80, thermal expansion in the circumferential length, and speed variation caused by thermal expansion in the roller 33. In other words, X is determined using the maximum variation amount Mv. Note that the first sampling count N is made sufficiently larger than the value of X that takes into account the amount of variation in the circumferential length. In the present example, N=1000, which is 10 times the value of X. Next, for each X (X=1 to 100), the period detection unit 207 calculates an evaluation value A(X) based on the reflected light amount Q1(i) and the reflected light amount Q2(i), using the equation below.

$$A(X) = \sum_{i=1}^{1000} |Q2(i+X) - Q1(i)|$$

The equation above is a value obtained by integrating the differences between the reflected light amounts in the first sampling and the reflected light amounts in the second sampling and the sampling values for which the differences are found are shifted by the value of X. As shown in the left side of the upper level of FIG. 9B, if the waveforms for the reflected amounts of light are similar at the sampling position i, the evaluation value A(X) is smaller, and as shown in the right side of the upper level of FIG. 9B, if the waveforms for the reflected amounts of light are not similar at the sampling position i, the evaluation value A(X) is larger. Note that the vertical axes in the upper level of FIG. 9B indicate the voltage value, and this is because the reflected light amounts output by the pattern detection sensor 50 are represented by the voltage values. The reflected light amounts from identical locations on the electrostatic conveyance belt 80 are approximately the same. Accordingly, as shown in the bottom level of FIG. 9B, the value of X at which the evaluation value A(X) is the smallest value indicates approximately the same position as the sampling start position at time t1 in FIG. 9A in the second sampling. More specifically, it is indicated that the X-th sampling position in the second sampling approximately corresponds to the first sampling position in the first sampling. Accordingly, the period detection unit 207 obtains Xmin, which is the value of X at which the evaluation value A(X) is the smallest, and calculates the rotation period T of the electrostatic conveyance belt 80 based on Xmin using the equation below.

$$T=(Xmin-Xid)\times S+(L\times V)$$

Note that L is the nominal belt length of the electrostatic conveyance belt 80, V is the belt speed obtained based on the diameter and the rotation speed of the roller driving the electrostatic conveyance belt 80, and Xid is half of the value of X. In this way, by measuring the reflection characteristic of the electrostatic conveyance belt 80, or in other words, by emitting a predetermined amount of light to the electrostatic conveyance belt 80 and measuring the reflected light amount from positions on the surface of the electrostatic conveyance belt 80, the reflection rate at positions on the surface of the electrostatic conveyance belt 80 is acquired. Then, the rotation period T can be calculated based on the periodicity of the reflection rate.

The sampling interval S will be described next. The sampling interval S and the rotation period detection error ΔT have the following relationship:

$$\Delta T=S/2$$

Here, for example, if P is the target correction accuracy in the correction of the magenta misregistration with respect to yellow, the target correction accuracy P and the rotation period detection error ΔT need to satisfy the condition below.

$$P\geq\Delta T\times V\times Lym/L$$

Accordingly, the sampling interval S can be selected such that the condition below is satisfied.

$$S\leq P\times 2L/(V\times Lym)$$

In the present embodiment, similarly to the first embodiment, after misregistration detection using developer images has been performed, the rotation period T1 is measured as described above using the periodicity of the reflected light from the surface of the electrostatic conveyance belt 80 and is used as the rotation reference value T1. Also, the temperature indicated by the temperature sensor 90 at this time is stored as a temperature reference value B1. If the internal temperature of the apparatus subsequently changes due to successive printing or the like, the belt speed will change due to the diameter of the roller 33 or the electrostatic conveyance belt 80 undergoing thermal expansion, and thereby misregistration will occur. In this case, the correction control unit 208 once again causes the period detection unit 207 to acquire the rotation period T2 and acquires a temperature B2 indicated by the temperature sensor 90. The correction control unit 208 derives the rotation period variation amount dT based on the rotation period T2, the temperature B2, the rotation reference value T1, and the temperature reference value B1 as described below.

First, a temperature variation amount dB is obtained using the equation below.

$$dB=f1\times(B2-B1)$$

Here, f1 is a coefficient for correcting the temperature difference between the temperature sensor 90 and the electrostatic conveyance belt 80 and is set in advance in the image forming apparatus. Next, the belt length change amount dL for the electrostatic conveyance belt 80 is obtained using the equation below.

$$dL=L\times f2\times dB$$

Here, f2 is a linear expansion coefficient for the member constituting the electrostatic conveyance belt 80, and it is set in advance in the image forming apparatus. A belt rotation period variation amount dT is obtained using the equations below.

$$L=T1\times V1$$

$$L+dL=T2\times V2$$

$$\begin{aligned}dT&=L/V2-L/V1=T2-T1-dL/V2\\&=T2-T1-(dL\times T2)/(L+dL)\end{aligned}$$

Thus, the belt rotation period variation amount dT can be calculated even if both the roller 33 and the electrostatic conveyance belt 80 undergo thermal expansion caused by a rise in the internal temperature. Note that the misregistration correction using the belt rotation period variation amount dT is similar to that of the first embodiment, and the description thereof will not be repeated.

Note that as shown in FIG. 8, the pattern detection sensor 50 is provided further downstream than the position where the recording medium 12 that was brought into close contact with the electrostatic conveyance belt 80 is separated from the belt. Because of this, the rotation period can be detected during a print operation as well, and similarly to the first embodiment, the rotation period can be detected in parallel with the print operation.

Third Embodiment

Next, a third embodiment will be described with a focus on differences from the second embodiment. In the second embodiment, misregistration is corrected by adjusting the emission timing of the scanner unit. In the present embodiment, misregistration is corrected by correcting the belt speed of the electrostatic conveyance belt 80. The configuration of the image forming apparatus and the rotation period detection method in the present embodiment are similar to those in the second embodiment. Note that the below-described image shift correction performed by correcting the belt speed can be applied to the configuration of the first embodiment as well.

Figure 10:
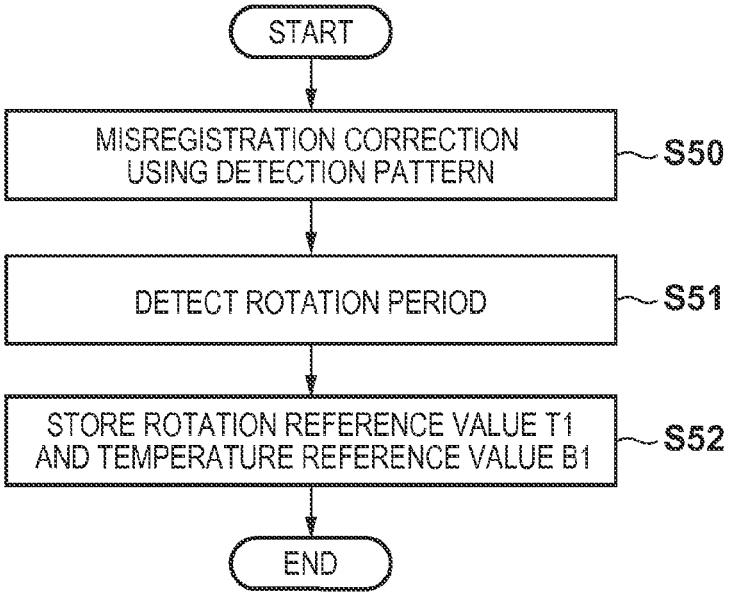
FIG. 10 is a flowchart for reference value acquisition processing according to an embodiment.

FIG. 10 is a flowchart for reference value acquisition processing according to the present embodiment. In step S50, the correction control unit 208 performs misregistration correction using developer image detection patterns, similarly to the first embodiment. In step S51, the correction control unit 208 detects the rotation period using the method described in the second embodiment and stores the rotation period T1 detected in step S51 in the RAM 220 or the non-volatile memory as the rotation reference value T1 in step S52. Also, the temperature indicated by the temperature sensor 90 at this time is also stored as the temperature reference value B1.

Figure 11:
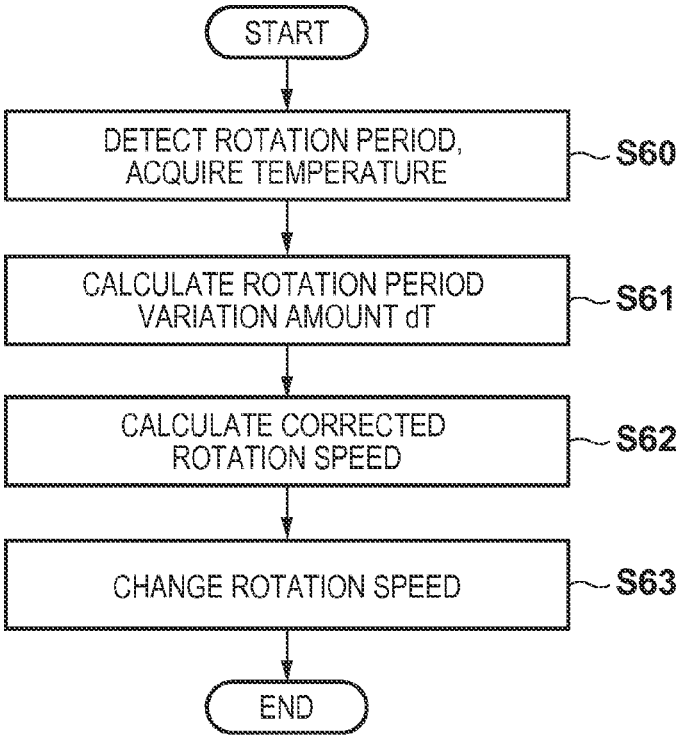
FIG. 11 is a flowchart for misregistration correction control according to an embodiment.

Misregistration correction control that is performed when the internal temperature of the apparatus changes due to successive printing or the like will be described next with reference to FIG. 11. Similarly to the case of the reference value acquisition processing, in step S60, the correction control unit 208 causes the period detection unit 207 to detect the rotation period and acquires the temperature from the temperature sensor 90. The rotation period detected here is T2, and the acquired temperature is B2. In step S61, the correction control unit 208 calculates the rotation period variation amount dT based on the rotation period T2, the temperature B2, the rotation reference value T1, and the temperature reference value B1, as described in the second embodiment. Next, in step S62, in order to correct the belt speed of the electrostatic conveyance belt 80, the correction control unit 208 calculates the corrected rotation speed of the roller 33 that drives the electrostatic conveyance belt 80.

The corrected rotation speed of the roller 33 is equal to the belt speed at the time of acquiring the reference values. Accordingly, if the rotation speed of the roller 33 at the time of acquiring the reference values is ω, the corrected rotation speed ωnew is expressed by the equation below.

$$\omega new=\omega\times V1/V2$$

Here, given that dT=V1/V2, ωnew is as follows:

$$\omega new=\omega\times dT.$$

Returning to FIG. 11, in step S63, the CPU 205 updates the rotation speed of the roller 33 that drives the electrostatic conveyance belt 80 to the value obtained in step S62. Accordingly, variation in the belt speed can be prevented and misregistration can be suppressed.

The calculation of the belt speed will be described next. First, the value of the actual belt circumferential length L' when the belt temperature is B' is stored in advance in the non-volatile memory. Note that this relationship may be a value determined in the design stage, at it may be a value measured at the factory. The actual belt speed V4 in the case of using T4 as the rotation period measured at a certain timing and using B4 as the temperature indicated by the temperature sensor 90 at that time can be calculated using the equation below.

$$dB'=f1\times(B4-B')$$

$$V4=L'\times(1+f2\times dB')/T4$$

Note that f1 and f2 are the coefficients that were described in the second embodiment. By calculating the belt speed V4 using the method above, for example, it is possible to perform primary transfer bias adjustment in which the appropriate image formation conditions need to be selected in accordance with variations in the belt speed.

Note that in the first embodiment, the belt rotation period is detected using marks provided on the intermediate transfer belt 30, but as in the second embodiment and the third embodiment, the rotation period may be obtained based on the reflection property of the belt. Furthermore, in the first embodiment as well, misregistration may be corrected by correcting the belt speed rather than the emission timing of the scanner unit 20. Furthermore, the rotation period of the electrostatic conveyance belt 80 can be detected using marks provided on the electrostatic conveyance belt 80, as in the first embodiment.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-091788, filed on Apr. 24, 2013, which is hereby incorporated by reference herein in its entirety.

What is claimed is:

1. An image forming apparatus comprising:

a rotating member;

a forming unit for each of a plurality of colors used in image formation, configured to form a developer image on a photosensitive member;

a transfer unit configured to transfer the developer image formed on the photosensitive member onto the rotating member or a recording medium on the rotating member;

a driving unit configured to rotate the rotating member;

a period detection unit configured to detect a rotation period of the rotating member, the rotation period being a value regarding a time duration while the rotating member rotates one rotation; and a control unit configured to, according to a detection result detected by the period detection unit, obtain a variation in the rotation period of the rotating member due to a change in the driving unit, and perform correction control for misregistration in the developer image transferred onto the rotating member or onto the recording medium on the rotating member.

2. The image forming apparatus according to claim 1, wherein the period detection unit is further configured to detect the rotation period of the rotating member by detecting a mark formed on the rotating member.

3. The image forming apparatus according to claim 2, wherein a plurality of marks are formed on the rotating member, and the period detection unit is further configured to detect the rotation period of the rotating member by measuring time for detecting the plurality of marks.

4. The image forming apparatus according to claim 1, further comprising:

a measurement unit configured to measure temperature, wherein, in the detection of the variation in the rotation period of the rotating member, the control unit is further configured to determine a change in the circumferential length of the rotating member based on the temperature measured by the measurement unit.

5. The image forming apparatus according to claim 1, wherein, in the correction control, the control unit is further configured to control a speed of a driving motor that transmits driving power to the driving unit that rotates the rotating member.

6. The image forming apparatus according to claim 1, wherein the forming unit is further configured to form the developer image on the photosensitive member by forming an electrostatic latent image on the photosensitive member and by developing the electrostatic latent image, and in the correction control, the control unit is further configured to control a forming position of the electrostatic latent image on the photosensitive member.

7. The image forming apparatus according to claim 1, wherein the control unit is further configured to obtain movement speed of the surface of the rotating member based on the variation in the rotation period of the rotating member.

8. The image forming apparatus according to claim 1, further comprising:

a misregistration detection unit configured to detect a misregistration detection pattern formed on the rotating member, wherein the detection performed by the period detection unit and the detection performed by the misregistration detection unit are performed in parallel.

9. An image forming apparatus, comprising:

a rotating member;

a forming unit for each of a plurality of colors used in image formation, configured to form a developer image on a photosensitive member;

a transfer unit configured to transfer the developer image formed on the photosensitive member onto the rotating member or a recording medium on the rotating member;

a driving unit configured to rotate the rotating member;

a period detection unit configured to detect a rotation period of the rotating member; and a control unit configured to, according to a detection result detected by the period detection unit, obtain a variation in the rotation period of the rotating member due to a change in the driving unit, and perform correction control for misregistration in the developer image transferred onto the rotating member or onto the recording medium on the rotating member by the forming unit, wherein the period detection unit is further configured to detect the rotation period of the rotating member by measuring a reflection characteristic of a surface of the rotating member.

10. The image forming apparatus according to claim 9, wherein the period detection unit is further configured to measure the reflection characteristic by emitting light to the surface of the rotating member and receiving reflected light.

11. The image forming apparatus according to claim 9, wherein the period detection unit is further configured to detect the rotation period of the rotating member by determining periodicity of the reflection characteristic.

12. The image forming apparatus according to claim 9, wherein the period detection unit is further configured to acquire first waveform data regarding the surface of the rotating member and second waveform data that includes at least a portion of the first waveform data, and detect the rotation period of the rotating member based on the first waveform data and the second waveform data.

* * * * *